US005195727A

United States Patent [19]

Liao et al.

[11] Patent Number: 5,195,727

[45] Date of Patent: Mar. 23, 1993

[54] TUBULAR SHOCK-ABSORBING DEVICE FOR A RAIL

[76] Inventors: Wan-ming Liao, No. 200, Hung-Guen Street Da-Chia Gien; Chun-Chien Yen, 24, Lin 9, Kui Ke Tsun, Ta-An hsiang, both of Tai-Chung Hsien, Taiwan

[21] Appl. No.: 854,358

[22] Filed: Mar. 18, 1992

[51] Int. Cl.[5] ..... A01K 3/00

[52] U.S. Cl. ..... 256/13.1; 248/66

[58] Field of Search ..... 256/13.1; 248/66

[56] References Cited

U.S. PATENT DOCUMENTS

| | | | |
|---|---|---|---|
| 2,030,782 | 2/1936 | Dennebaum | 256/13.1 |
| 2,056,858 | 10/1936 | Irons et al. | 256/13.1 |
| 2,067,887 | 1/1937 | Camp | 256/13.1 |
| 2,238,523 | 4/1941 | Hoist | 256/13.1 |
| 2,776,116 | 1/1957 | Brickman | 256/13.1 |

FOREIGN PATENT DOCUMENTS

| | | | |
|---|---|---|---|
| 684871 | 3/1965 | Italy | 256/13.1 |

*Primary Examiner*—Andrew V. Kundrat
*Attorney, Agent, or Firm*—W. Wayne Liauh

[57] ABSTRACT

A tubular shock-absorbing device including a post, a block having a curved surface for engagement with the post and having a waved surface, both ends of the block having reinforcing flanges which are cast into form integrally, a curb which has a waved shape being engaged with the waved surface of the block, and a bolt fixing the curb and the block and the post together, so that the block forms a buffer.

3 Claims, 3 Drawing Sheets

TUBULAR SHOCK-ABSORBING DEVICE FOR A RAIL

BACKGROUND OF THE INVENTION

As shown in FIG. 5, a typical rail 42 is fixed to a wood block 41 and is fixed to a post 4 by a bolt 43 and a washer 44. The wood block 41 is parallelepiped and includes six flat outer surfaces so that the contact area between the post 4 and the block 41 and between the block 41 and the rail 42 is very small so that the rail 42 can not be stably retained in place.

SUMMARY OF THE INVENTION

A tubular shock-absorbing device including a post, a tubular member having a curved surface at its rear face for engagement with the post and a wavy surface at its front face, a curb which has a wavy shape being engaged with the waved surface of the block, and a bolt fixing the curb and the tubular member and the post together, so that the tubular member forms a buffer.

The objective of the invention is to provide a supporting device which can stably support the curb in place. Both ends of the tubular member 12 are furnished with reinforcing flanges 123 respectively for reinforcement purpose so as to resist impact.

DETAILED DESCRIPTION

Figure 1:
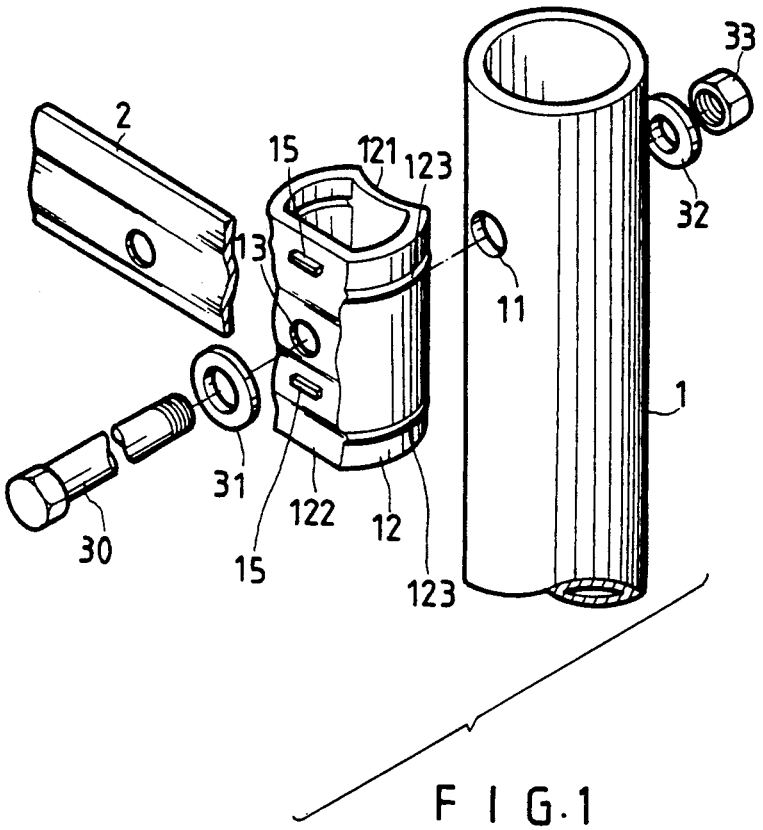
FIG. 1 is an exploded view of a supporting device.
Figure 2:
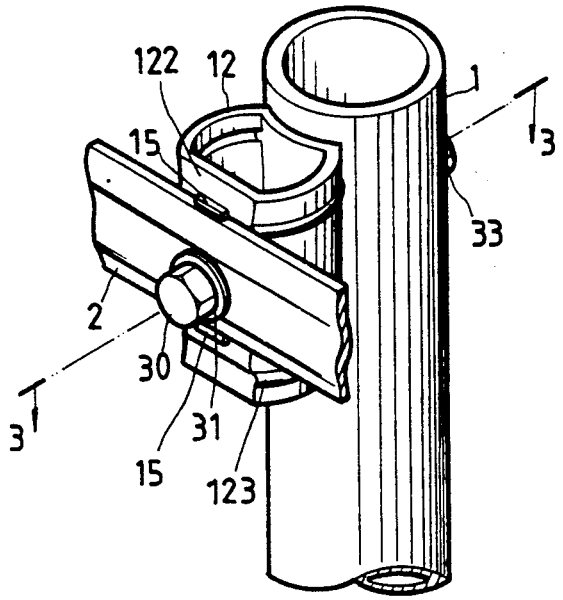
FIG. 2 is a perspective view of the supporting device.
Figure 5:
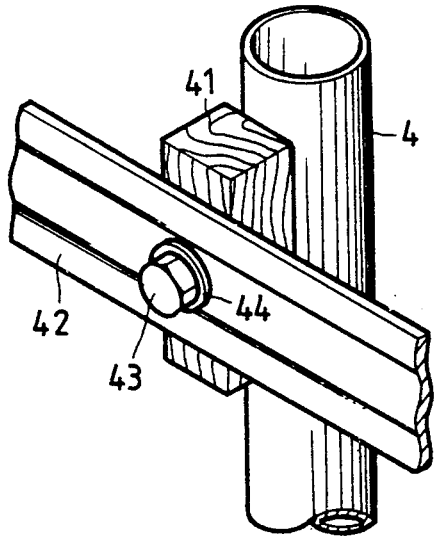
F I G. 5 ( PRIOR ART )
FIG. 5 is a perspective view of the typical supporting device for curb.
Figure 3:
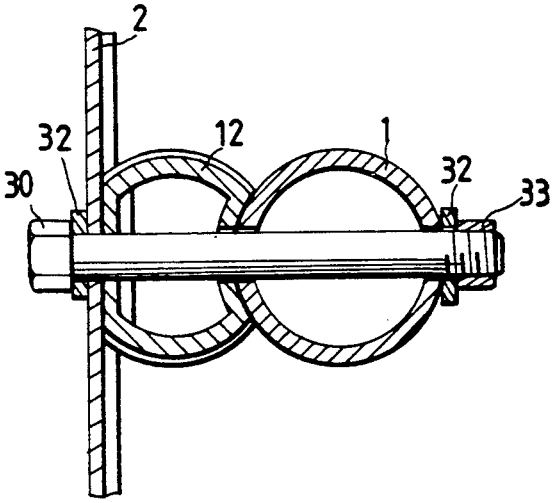
FIGS. 3 and 4 are cross sectional views taken along lines 3—3 of FIG. 2.

Referring to the drawings, and initially to FIGS. 1 to 3, a supporting device comprises a post 1 having an aperture 11 formed therein, and a tubular member 12 having a curved surface 121 formed in a rear portion for engagement with the post 11 and having a wavy surface 122 formed in a front portion and including an orifice 13 formed therein. The reinforcing flanges 123 on both ends of the block 12 are formed integrally upon the block being cast; the reinforcing flanges are for reinforcement purpose to resist impact. The wavy shape of the front surface 122 of the block 12 is similar to that of the rail 2 so that the rail 2 can be stably engaged with the wavy surface 122 of the tubular member 12. A bolt 30 passes through the rail 2 and the orifice 13 of the tubular member 12 and the aperture 11 of the post 1 so as to fixed the same together. Two washers 31, 32 are engaged on the bolt 30. and a nut 33 is fixed on the free end of the bolt 30.

It is preferable that at least one rib 15 is formed on the waved surface 122 of the block 12 for engagement with the upper edge and the lower edge of the rail 2 so that the curb 2 can further be retained in place.

Figure 4:
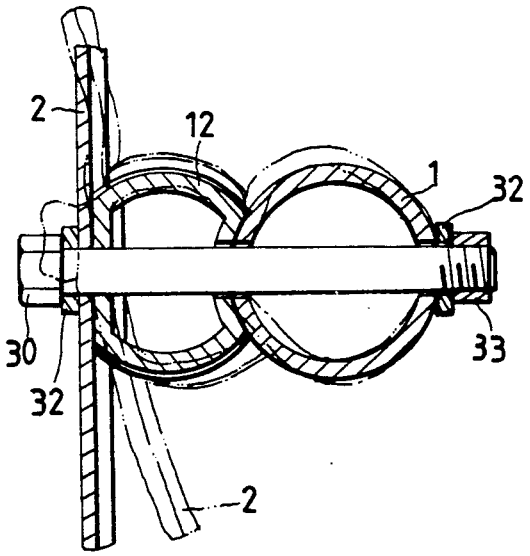

Referring next to FIG. 4, the tubular member 12 will be deformed first before the post 1 when the rail 2 is hit or struck by an object so that the tubular member 12 forms a buffer between the rail 2 and the post 1.

We claim:

1. A tubular shock-absorbing device comprising a post, a tubular member having a front face, a rear face, and two side faces, said rear face having a curved surface for engagement with said post, said front face having a wavy surface, and each of said side faces having at least one reinforcing flange which is cast integrally with said tubular member, a rail which has a wavy shape engageable with said wavy surface of said front face of said tubular member, and a bolt which penetrates through said rail, said tubular member and said post to form said tubular shock-absorbing device.

2. A tubular shock-absorbing device according to claim 1 wherein said wavy surface of said front face of said rail includes at least one rib formed thereon for engagement with the upper edge or the lower edge of said rail so that said rail can be more securely retained in place.

3. A tubular shock-absorbing device according to claim 1 wherein said tubular member is a seamless tubular member.

* * * * *